United States Patent [19]

Roberson

[11] Patent Number: 4,833,805

[45] Date of Patent: May 30, 1989

[54] DISPLAY SIGNS

[76] Inventor: Carl H. Roberson, 111 Buck Alley, Ringgold, Ga. 30736

[21] Appl. No.: 115,378

[22] Filed: Nov. 2, 1987

[51] Int. Cl.[4] ..... G09F 17/00

[52] U.S. Cl. ..... 40/603

[58] Field of Search ..... 40/603, 604, 155; 160/378, 402, 372, 373; 38/102.5, 102.91

[56] References Cited

U.S. PATENT DOCUMENTS

| | | | |
|---|---|---|---|
| 3,273,497 | 9/1966 | Rosema et al. | 160/378 |
| 3,465,461 | 9/1969 | Price et al. | 40/155 |
| 4,430,819 | 2/1984 | Chandler | 40/603 |
| 4,554,754 | 11/1985 | Stilling | 40/603 |
| 4,674,213 | 6/1987 | Keithley | 40/603 |

FOREIGN PATENT DOCUMENTS

| | | | |
|---|---|---|---|
| 624897 | 6/1949 | United Kingdom | 160/402 |

*Primary Examiner*—Gene Mancene
*Assistant Examiner*—Cary E. Stone
*Attorney, Agent, or Firm*—Alan Ruderman

[57] ABSTRACT

A display sign and a method of retrofitting a display sign has a number of conventional structural frame members about which a flexible facing material is attached. The frame members have rods fastened to surfaces thereof remote from the front of the facing. For larger signs adjacent frame members may be connected together by the facing material and have cooperating adjustment members which permit adjacent frame members to be moved apart to expand the size of the frame members and simultaneously stretch the facing. The frame members and the facing material are positioned within a display sign cabinet having an opening just slightly greater than that of the margin of the frame members, and the border of the frame members may be adjustably moved apart by a pivotal movement about the rods as a fulcrum on the frame is secured to framework within the sign housing to snuggly fit within the opening.

21 Claims, 2 Drawing Sheets

DISPLAY SIGNS

BACKGROUND OF THE INVENTION

This invention relates to display sign assemblies of the type having flexible sheet display faces, and more particularly to a display sign assembly of this type which may be readily constructed from relatively inexpensive elements and which permit the flexible faces to be stretched in a simplified manner.

The development of outdoor display signs for identifying and promoting places of business, such as motels, restaurants and the like, has progressed from painted sign boards, "neon" signs, glass or similar transparent face displays through rigid plastic panelling until the development of a stretchable fabric-like material. This development is ablely traced in the disclosure of Brooks U.S. Pat. No. 4,265,039. The advantages of the stretchable fabric-like material, which is marketed by 3M Company under the trademark PANAFLEX and by Signtech, Inc. under the trademark FLEXFACE includes its ability to flex under high wind conditions so as not to burst or blow-out of the cabinet in which it is mounted which was a problem of the rigid facing.

Because of the necessity for tensioning the stretchable material, the known display signs have utilized aluminum extrusions having various cross sectional configurations and fabric tensioning devices in combination therewith. Examples of display signs utilizing such extrusions include the aforesaid Brooks patent and Gandy U.S. Pat. No. 4,452,000. Even before the development of the flexible face signs, extruded aluminum sign frames were extensively employed. Examples of display signs incorporating such extrusions include Brooks U.S. Pat. No. 4,007,552; Kloke U.S. Pat. No. 4,267,657 and Gandy U.S. Pat. No. 4,380,880. Obviously, specialized extrusions result in expensive sign fabrication, and because of the fabric stretching mechanisms utilized with such extrusions the labor costs for precisely tensioning the fabric in the display sign frame and within the display sign cabinet is substantial.

The extruded frame constructions stretch the flexible sheet material by wrapping the material about a plurality of retainer bars or wedges, or the like, spaced successively about the peripheral length of the extrusion, generally approximately every 12 inches. In the aforesaid Gandy U.S. Pat. No. 4,452,000 retainer bars are individually adjustably moved by bolt members while in Brooks U.S. Pat. No. 4,265,039 extruded levers receive cylindrical wedges and the levers are individually pivoted. In either case the retainers or wedges are moved into and relative to recesses formed in the extrusions for this purpose. Since the flexible sheet is wrapped about the bars or wedges it is incrementally stretched as each of the retaining bars or wedges move relative to the extrusion.

Additionally, the extruded cabinet and frames require specialized corner pieces which must be specially cast so as to fit the extrusions.

When retrofitting signs having the extruded components, the sign frame must be removed, the face disconnected by means of the retainers or wedges, a new face installed by individually securing and adjusting the multiplicity of retainers or wedges and reattaching the frame. Alternatively a workman must enter the cabinet and disconnect each of the retaining members or wedges from its connection with the facing, and thereafter individually reattaching the retainers or wedges to the facing, and adjusting each one until the tension on the face is proper. Clearly this is a tedious and expensive labor intensive process. Moreover, when retrofitting a flexible face sign in place of a rigid face sign the extrusion must be assembled so as to exactly fit the exterior of the preexisting cabinet. This usually requires that a substantial number of screws being clearly visible on the exterior of the cabinet detracting from the aesthetics of the sign.

The extruded constructions therefore have a number of deficiencies not the least of which is that they must be individually fitted to preexisting cabinets when retrofitting, and additionally the facing has to be stretched separately by independent stretching members disposed about the periphery thereof. All of the above mentioned factors obviously add to the cost of replacing a display sign. Additionally, display signs constructed from extrusions do not have the strength and durability of the steel angle or channel member framework signs which were the mainstay of the earlier rigid face signs since the extrusions tend to bend, and a substantial amount of brace-work must be included to prevent twisting under high wind conditions.

SUMMARY OF THE INVENTION

Accordingly, it is a primary object of the present invention to provide an improved display sign having flexible face display material mounted on framing which does not utilize extrusions.

It is another object of the present invention to provide display signs constructed from conventional structural members about which flexible facing material may be readily attached, the members being adjustable relative to each other and to the sign cabinet so as to fit the cabinet structure and stretch the facing material in unison.

It is a further object of the present invention to provide display signs having framework about which a cabinet skin is disposed, the cabinet receiving flexible face sign material stretched about conventional structural elements which may be positioned within the cabinet and securely positioned therein without utilizing aesthetically distracting attaching means, the display signs having the necessary ruggedness to withstand the large pressures of high wind forces.

It is a still further object of the present invention to provide a method for retrofitting display signs having flexible sign facing, the method including prestretching the facing prior to field fitting wherein the facing is further stretched as the members to which it is attached are fitted to the existing sign cabinet.

Accordingly, the present invention provides a display sign comprising a housing or cabinet including supporting framework having an outer sleeve, a number of conventional structural frame members about which a flexible facing material is clamped, the facing frame members or the framework having fulcrums about which the facing frame members may be pivoted to separate opposed borders thereof so as to stretch the facing and size the borders to fit precisely within the sleeve. Additionally, for larger signs the invention includes provisions for interconnecting adjacent facing frame members by adjustable means which permit the frame members to be positioned relative to each other to stretch the facing and size the borders of the frame members for attachment to a display sign cabinet. The facing frame is positioned within the opening of the cabinet and bolted to the framework. As the bolts are tightened the respective facing frame members pivot about its fulcrum relatively to the framework to expand its borders and stretch the facing. For larger signs the frame members may be further adjusted by the interconnecting adjustable means. The adjustability of the frame members is such that additional fastening elements to attach them to the sleeve is rendered unnecessary. Thus, not only may a flexible face display sign be constructed which is structurally sound and more rugged than prior art signs, but such signs may be aesthetically more attractive.

The flexible material frame members may be utilized with conventional display sign cabinets by pre-stretching and sizing in the shop and thereafter adjusting to the precise size in the field, thereby permitting much less costly the retrofitting of display signs than heretofore practical and without tying up large expensive cranes or the like for more than short periods.

In the preferred form of the invention, the flexible face frame comprises conventional angle beam members the beam members having fulcrum rods welded thereto if an existing sign is to be retrofit, or the rods are welded to the framework if the sign is newly constructed. Additionally, and especially for larger signs, the beam members are secured together by the flexible face material itself, and adjacent beam members may be interconnected by cooperating rod-type members which may be adjustably moved relative to each other to expand the frame and stretch the flexible facing thereby to precisely size the periphery of the beam members and the facing. Simple U-shape clamps secure the facing to the beam members.

When retrofitting a sign face, the interior dimension of the cabinet is approximated by the frame beam members in the shop. The facing is thereafter stretched about and clamped to the beam members, and may thereafter stretched slightly more by adjusting the rod members. Thereafter the facing and beam members are inserted into the cabinet opening and the beam members bolted to the cabinet framework. As the bolts are tightened the beam members pivot to fit the opening and stretch the facing even further, and where adjusting rods are utilized they may be trimmed to precisely and tightly fit the frame into the cabinet opening while further stretching the facing minute amounts.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
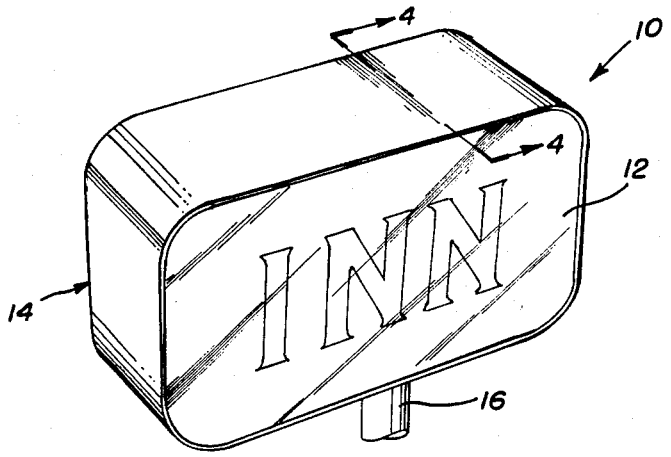
FIG. 1 is a perspective view of a display sign assembly constructed in accordance with the principles of the present invention.
Figure 4:
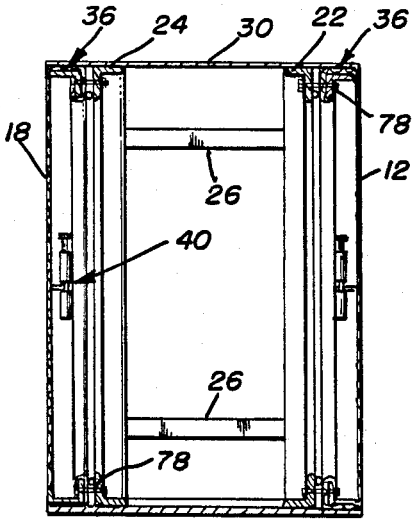
FIG. 4 is a vertical cross sectional view taken substantially along line 4—4 of FIG. 1.

Referring to FIG. 1, a display sign assembly 10 constructed in accordance with the present invention is illustrated, the assembly comprising a sign face 12 disposed within an opening at one end of a cabinet or housing 14 which may be carried on a support such as the top of a support post 16 or other elevated structure such as the top of a building or the like. As illustrated in FIG. 4 a sign face 18 similar to face 12 may be carried by the housing 14 at the opposite end thereof as is usual and conventional with such display signs. The mounting of the sign faces 12 and 18 are identical, and the novel mounting provided by the present invention as hereinafter disclosed in conjunction with face 12 should be understood to be applicable equally to face 18.

Figure 2:
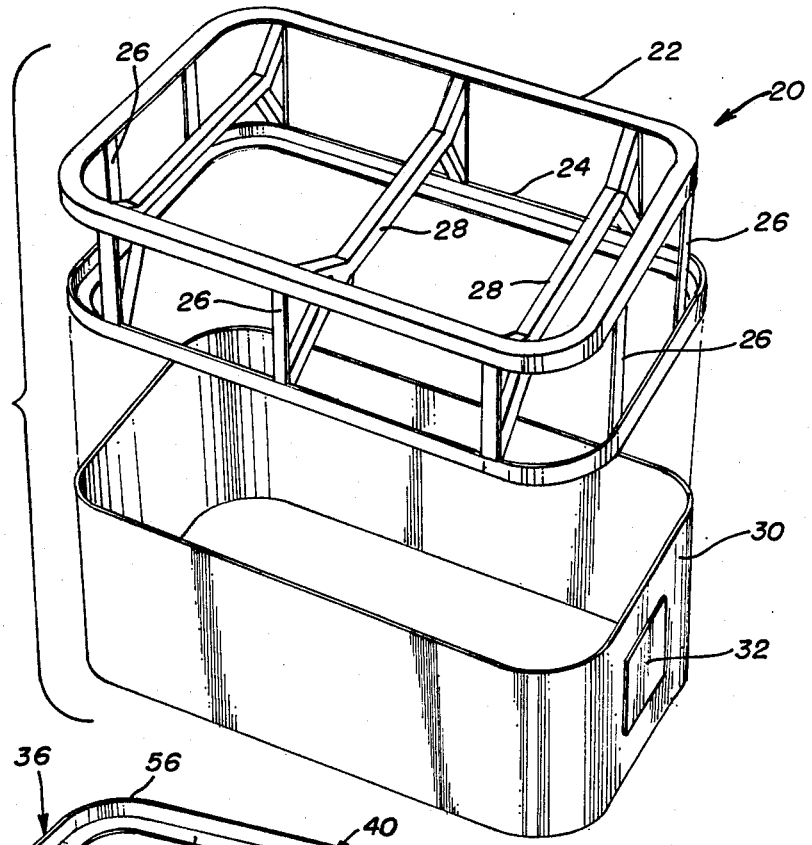
FIG. 2 is an exploded perspective view illustrating the construction of the sign cabinet of the assembly of FIG. 1.
Figure 3:
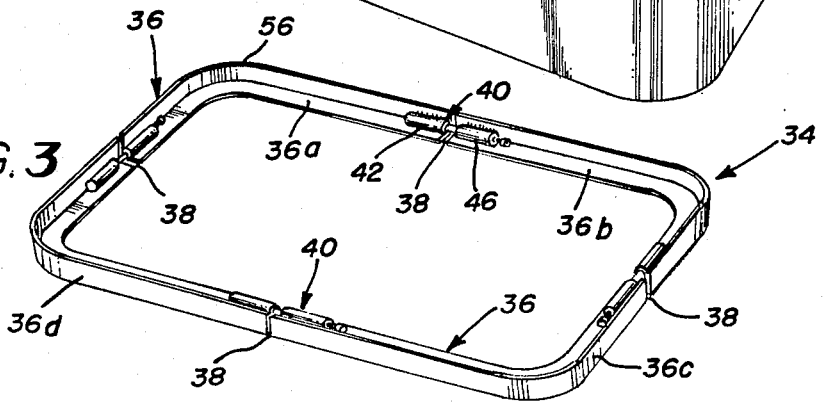
FIG. 3 is a perspective view of the sign face carrying frame, but with the facing removed so as to illustrate the frame construction.
Figure 10:
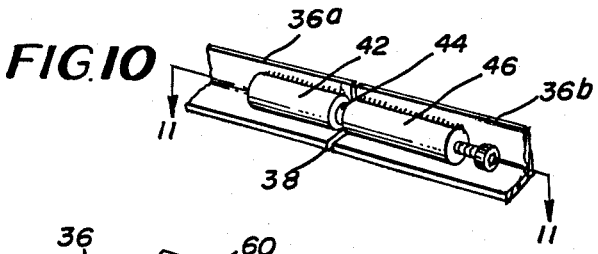
FIG. 10 is a fragmentary perspective view of one of the adjustable frame expanding and face stretching members.
Figure 11:
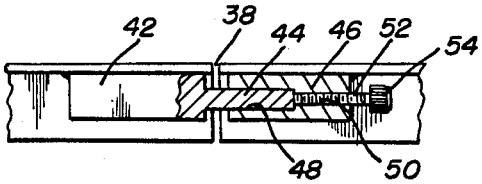
FIG. 11 is a cross sectional view taken substantially along line 11—11 of FIG. 10.

As illustrated in FIG. 2, the cabinet or housing 14 comprises an inner framework 20 having a plurality of structural members including front and rear framing 22, 24 forming the borders of the cabinet and interconnected by support beams 26 and a plurality of braces 28, the number of beams 26, braces 28 and similar strengthening members being dependent upon the size and shape of the display sign. Illumination means such as lighting fixtures or the like and the necessary wiring harnesses, ballasts and other means for illuminating the sign from within the housing are understood to be disposed therein, but for purposes of clarity are not illustrated since they are not necessary for a full understanding of the present invention.

Tightly disposed about the inner framework 20 of the cabinet 14 is a sheet metal sleeve or skin 30 which covers the framework and provides an exterior covering surface except at the front and rear, the skin 30 being connected to the framework 20 by conventional means such as rivets or the like. A door 32 provides access to the interior of the cabinet or housing for maintenance and repair of the lighting and wiring and for any required adjustments to the sign facing frame as described herein.

The facing 12 is a stretchable light-transmitting material, which as aforesaid may be the 3M Company PANAFLEX brand reenforced fabric-like material having thereon the desired graphics and coloration desired by the establishment or place of business to be identified by the display sign. Such facing material may be preformed and sized to be slightly larger than the peripheral dimensions of the display sign. As aforesaid, in the prior art the mounting and the proper tensioning of the facing required the use of expensive extruded structural members which additionally required special stretching and securing members. The present invention, however, provides a system having a frame 34 comprising conventional structural members which may be channel members or may be simple angle beam members, which are preferred and which is generally indicated at 36. Preferably the beam members 36 are constructed from aluminum, although other structural materials may be utilized for this purpose. The beam members 36 may be formed by bending so that the corners for a rectangular shaped sign may be rounded as illustrated, or such corners may be formed and fabricated from additional members attached to the side rail members. If a sign of a configuration other than rectangular is desired, the members 36 may be formed and fabricated to the desired shape.

For large size signs, it is preferred that each peripheral edge of the frame 34 be constructed from at least two beam members 36 or be otherwise split to form a gap 38 at a joint adjacent ends of adjacent beam members 36*a*, 36*b*, 36*c*, 36*d*. Thus, for a substantially rectangular shaped sign as illustrated in the preferred embodiment there would be four such gaps or partitions. Although it should be understood from the disclosure herein that a greater number of such gaps or splits may be used without departing from the principles of the present invention, the use of four in regard to a rectangular frame minimizes the number of stretching adjustments while permitting the facing to be properly stretched. For other than rectangular frames, the number of joints with gaps therebetween may be more or less. A triangular shaped sign may, for example, require three such joints. At each joint there is provided a frame expanding and face stretching assembly generally indicated at 40.

Each assembly 40 comprises a first body member 42 fastened to one of the beams such as beam 36*a* adjacent the joint or gap 38 as by welding or the like, the member 42 having a rod-like extension 44 facing toward and extending beyond the joint 38 toward the adjacent beam 36*b*. Each assembly 40 also includes a second body member 46 which is fastened to the adjacent beam such as beam 36*b*, as by welding, adjacent the joint 38, the body member 46 having a hollow or bore 48 therein for receiving the extension member 44 of the member 42 with which it is aligned. The bore 48 extends partially through the body 46 where it opens into another bore 50 which preferably is tapped for receiving a threaded rod or bolt 52 having a head 54 on its free end. Preferably, for ease of manufacturing, the body members 42 and 46 together with the extension 44 and the bore 48 are of cylindrical configuration, although other cross sectional configurations are conceivable. As will be understood, when the beams 36*a* and 36*b* are in juxtaposition with each other the extension 44 is received within the bore 48 and the gap 38 initially may be positioned as determined by the bolt 52 at a location so that the outer periphery of the frame is just slightly smaller than that of the opening in the cabinet or housing 14. Thereafter the gap 38 between the beam members 36*a* and 36*b* may be opened merely by torquing the bolt head 54. Thus, the peripheral borders of the frame may be expanded merely by turning the bolt 52 so that it may be precisely positioned within the cabinet sleeve or skin 30 after the facing 12 has been attached to the frame in a manner now to be described.

Figure 5:
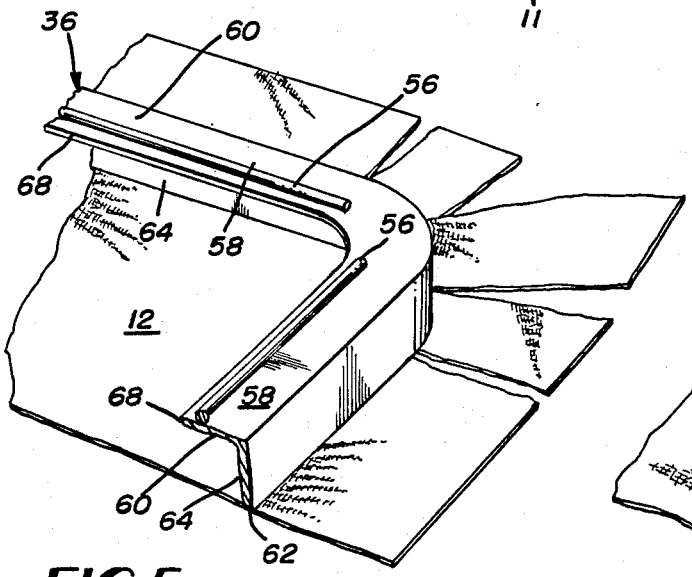
FIG. 5 is a fragmentary perspective view illustrating a portion of the frame shown in FIG. 3 during an initial step in attaching the facing thereto.
Figure 6:
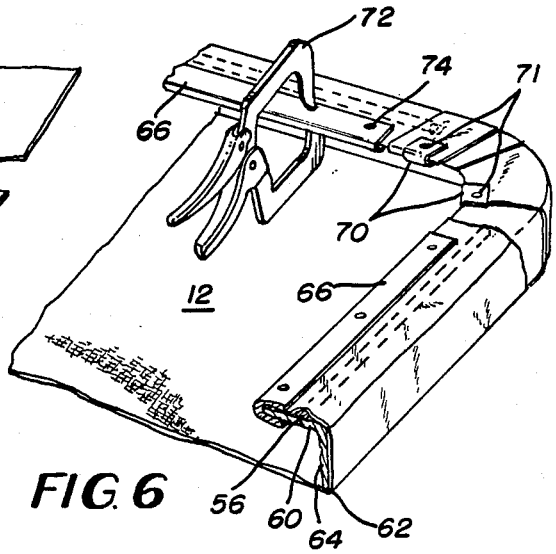
FIG. 6 is a view similar to FIG. 5, but of a subsequent step illustrating the initial clamping of the facing to the frame.
Figure 9:
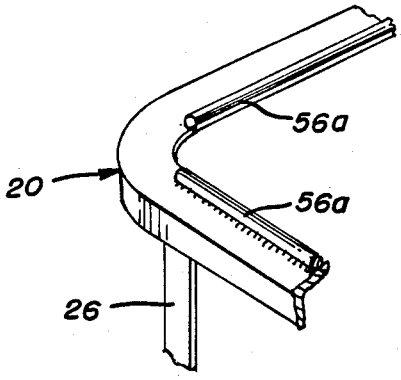
FIG. 9 is a fragmentary perspective view of an alternate form of the inner framework illustrated in FIG. 2.

In the case of signs which are to be retrofit in the field, each beam 36 or, in the case of the larger signs, each beam member 36*a*, 36*b*, 36*c*, 36*d*, has a bar preferably in the form of an elongated cylindrical rod 56 secured as by welding to the rear face 58 of the leg 60, which as illustrated in FIGS. 5 and 6 are the legs which are remote from the front surface of the facing 12. The rods 56 extend in the longitudinal direction of the beam members at least a substantial length along each face 58. As will hereinafter become clear, the rod 56 acts as a fulcrum about which the frame pivots for stretching the facing and fitting the frame 34 in the cabinet. In those instances where a sign is newly manufactured, the fulcrum is preferably welded to the framework 20 as illustrated by rods 56*a* in FIG. 9. In either case, the rods 56 or 56*a* may be $\frac{1}{4}$ inch to $\frac{1}{2}$ inch depending on the amount of facing stretch desired.

The facing 12, as illustrated in FIG. 5, is positioned with the exterior or graphics carrying face on a clean planar surface, such as a table or the floor with protection therebetween if positioned on the floor. The frame 34, and in the case of the expandable beams with the beam members 36 extended by the bolts 52 to just slightly less than the opening in the cabinet 14, is disposed on the rear or interior surface of the facing with the edge 62 of the angle beams 36 abutting the rear of the facing. The facing is then folded over the legs 64 and 60 of the beams 36 and the portions which form the corner are either folded or cut as illustrated in FIG. 5 and folded over the corners of the framing. As each edge, i.e., the selvage, of the facing is folded over the respective legs 64 and 60, it is pulled taut and U-shaped clamps 66 having legs spaced apart by an amount substantially equal to the thickness of the legs 60 of the beams 36 are positioned so as to sandwich the facing 12 and the free edge portion 68 of the beams 36 between the legs of the clamp. For the larger signs there may be two elongated clamps 66 used for each of the sides, one on either side of the joint gap 38, while smaller clamp versions 70 may be used at the corners, the exact number and size of the clamps being dependent upon the size of the sign. Of course, more than two clamps 66 may be used for each side but three would be preferable since less assembly time is required. The clamps 70 are fastened by screws 71 to the corners of the beams to trap and secure the facing to the beams at those locations, while C-clamps 72 or the like temporarily hold the elongated U-shaped clamps 66 to the remainder of the beam 36. Thereafter, in the case of the expandable beams, the bolts 52 may be threaded further into the bores 50 at each side so as to force the respective extension 44 outwardly from the bore 48 and thereby move the beams, such as beam 36*a* and 36*b*, relative to each other to open the gap 38 at the joint between the beams. This action further stretches the facing of the expandable beams while it is held by the clamps 66 and 72. For both the smaller and larger signs when the facing is stretched to the desired amount, screws 74 are inserted into the clamps 66 through the beams 36 and the C-clamps 72 are removed. The frame 34 together with the facing is then ready to be mounted within the cabinet 14.

Figure 7:
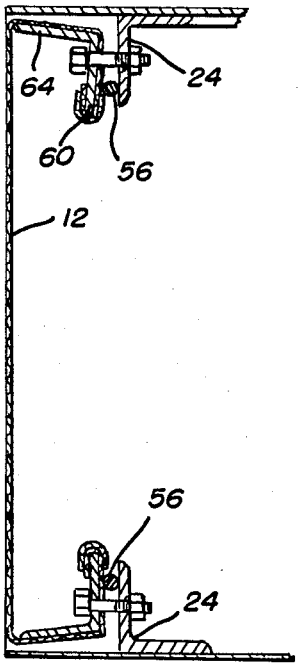
FIG. 7 is a view similar to FIG. 4, but greatly enlarged and broken away to show a fragment thereof.
Figure 8:
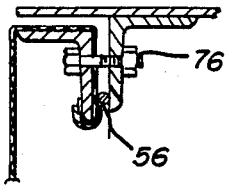
FIG. 8 is a view similar to FIG. 7, but of a smaller fragment illustrating an initial step in the mounting of the facing frame in the cabinet.

As illustrated in FIGS. 7 and 8 the frame 34 together with the facing 12 is positioned within the opening of the housing 14 and pop rivets or bolts 76 are inserted through corresponding openings formed in the leg 60 and the framing 22, 24 of the framework 20. As the pop rivets or bolts 76 are tightened, the beams 36 pivot about the rods 56 as a fulcrum. The bolts 76 are spaced from the rods 56 in the direction toward the corner between the legs 60 and 64 so that the edges 62 tilt toward the adjacent peripheral surface of the sleeve 30.

As opposite sides of the frame 34 are tightened the respective edges become separated further and the facing is further stretched. The bolts 76 may be tightened until the edges 62 with the facing thereon abuts the inner surface of the sleeve to provide a neat and tight fit. For the larger size signs additional adjustments may be made by tightening the bolts 52. The adjustments are readily accomplished by conventional tools for turning the heads of the bolt 52 and 76 and when properly tightened the unsightly screws or the like on the exterior of the signs of the prior art are not required for holding the frame to the cabinet since it is held from within by the frictional clamping fit.

Since the frame is constructed from conventional structural beam members the frame structure has great strength, and since the beams 36 and the facing 12 are expanded and stretched together into a precisely fitting relationship within the cabinet, the structure provides labor saving steps in mounting the frame and facing to the cabinet. Not only may new signs be constructed in accordance with the present invention, but when retrofitting or replacing a sign facing, a replacement frame and facing fabricated in the manner taught by the present invention may be substituted for that previously used. The costly extrusions and labor intensive installations of the prior art are thereby avoided in a simple and inexpensive manner.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A display sign comprising a housing having interior framework and a sleeve disposed about the framework to define a peripheral border extending about an opening, a frame disposed within said opening, a sheet of stretchable sign face material secured to said frame for disposition across said opening, said frame comprising a plurality of beam members, said beam members being disposed in juxtaposition relative to each other to provide a peripheral margin conforming to the geometric configuration of said opening and of a size for fitting within said opening, said margin extending between forward and rear faces of said frame, said sign face material being tightly disposed about the peripheral margin of said beam members and closing the forward face of said frame, said sign face material having a selvage wrapped over said beam members at the rear face of said frame, clamp means for fastening said facing to said beam members at the rear face adjacent said selvage, fulcrum means disposed intermediate said rear face and said framework, and means for securing said beams to said framework while pivoting said beam members about said fulcrum means to enlarge said peripheral margin to fit tightly within said opening and stretchably tension said sign face material.

2. A display sign as recited in claim 1, wherein said fulcrum means comprises rods secured to said rear face of said frame.

3. A display sign as recited in claim 1, wherein said fulcrum means comprises rods secured to said framework.

4. A display sign as recited in claim 1, wherein said clamp means maintains said beam members together as a unit, and frame expanding members fastened to said beam members for adjustably moving adjacent beam members apart selectively to enlarge said peripheral margin and stretchably tension said sign face material.

5. A display sign as recited in claim 4, wherein said frame expanding members comprise first and second cooperating body members, said first body member being fastened to a first beam member and said second body member being fastened to an adjacent beam member, said first body member having an extension protruding beyond the first beam member, said second body member having a bore for receiving said extension, and threaded means adjustably received within said second body member for abutting said extension and for adjustably moving said extension out of said bore selectively thereby to move said first and second beam members apart.

6. A display sign as recited in claim 4, wherein said frame expanding members comprise a first body member fastened to a first beam member and a second body member fastened to an adjacent beam member, coacting means for cooperatively interconnecting said first and second body members together, and adjustment means for moving said body members away from each other selectively.

7. A display sign as recited in claim 6, wherein said clamp means comprises a U-shaped clamp having a pair of spaced apart limbs, said limbs being spaced apart by an amount substantially equal to the thickness of said leg and being disposed on a free end of said leg with at least one of said limbs overlaying said leg and abutting sign face material disposed on said leg, and means for securing said U-shaped clamp to said leg.

8. A display sign a recited in claim 4, wherein said opening has a substantially rectangular shape, and said beam members comprise at least a pair of adjacent beams defining each side of said peripheral margin.

9. A display sign as recited in claim 8, wherein said frame expanding members comprise first and second cooperating body members, a first body member being fastened to each of said beam members and said second body member being fastened to each of said beam members adjacent a corresponding first body member, each of said first body members having an extension protruding beyond the beam member to which it is fastened, each of said second body members having a bore for receiving the extension from the corresponding first body member, and threaded means adjustably received within each second body member for abutting the corresponding extension and for adjustably moving said corresponding extension out of the respective bore selectively.

10. A display sign as recited in claim 1, wherein said beam members comprise angle beams, each angle beam having a pair of legs, one of said legs having an edge forming said forward face of said frame, and a second leg spaced from and substantially parallel to said forward face.

11. A display sign as recited in claim 10, wherein said clamp means comprises a U-shaped clamp having a pair of spaced apart limbs, said limbs being spaced apart by an amount substantially equal to the thickness of the second leg and being disposed on a free end of said second leg with at least one of said limbs overlaying the second leg and abutting sign face material disposed on the second leg, and means for securing said U-shaped clamp to said second leg.

12. A display sign as recited in claim 1, wherein said beam members include a leg at said rear face of said frame spaced from and substantially parallel to said forward face of the frame and to the sign face material closing said forward face, said fulcrum means comprising a rod secured to said leg at a face remote from said forward face.

13. A display sign as recited in claim 12, including frame expanding members fastened to said beam members for adjustably moving adjacent beams apart selectively, said frame expanding members comprising a first body member fastened to a first beam member and a second body member fastened to an adjacent beam member, coacting means for cooperatively interconnecting said first and second body members together, and adjustment means for moving said body members away from each other selectively.

14. A display sign as recited in claim 12, including frame expanding members fastened to said beam members for adjustably moving adjacent beams apart selectively, said frame expanding members comprising first and second cooperating body members, said first body member being fastened to a first beam member and said second body member being fastened to an adjacent beam member, said first body member having an extension protruding beyond the first beam member, said second body member having a bore for receiving said extension, and threaded means adjustably received within said second body member for abutting said extension and for adjustably moving said extension out of said bore selectively thereby to move said first and second beam members apart.

15. A display sign as recited in claim 12, wherein said clamp means comprises a U-shaped clamp having a pair of spaced apart limbs, said limbs being spaced apart by an amount substantially equal to the thickness of said leg and being disposed on a free end of said leg with at least one of said limbs overlaying said leg and abutting sign face material disposed on said leg, and means for securing said U-shaped clamp to said leg.

16. The method of fitting a rigid housing display sign with a stretchable material sign facing, said housing having a peripheral border extending about an opening, said method comprising:

(a) disposing said facing tightly about a frame having a peripheral margin conforming to the geometric configuration of said opening and of a size slightly smaller than said opening, (b) securing said facing to said frame, (c) positioning said frame within said opening, and (d) thereafter enlarging said margin by tilting opposed peripheral portions of said frame to move apart to tightly fit within said opening while simultaneously stretching said facing.

17. The method as recited in claim 16, wherein said frame is attached to framework within said housing, and said tilting comprises pivoting said portions about fulcrums as said frame is attached to said framework.

18. The method as recited in claim 16, wherein said frame is expanded to enlarge said margin and stretch said facing.

19. The method as recited in claim 18, wherein said frame comprises a plurality of beams and said expanding comprises adjustably moving adjacent beams apart.

20. The method as recited in claim 16, wherein said disposing of said facing about said frame comprises positioning the frame on the facing, wrapping the facing about the peripheral margin, clamping the facing, and expanding said frame to stretch said facing.

21. The method as recited in claim 20, wherein said frame comprises a plurality of beams and said expanding comprises adjustably moving adjacent beams apart.

* * * * *